US007942594B2

(12) United States Patent
Kumazaki et al.

(10) Patent No.: US 7,942,594 B2
(45) Date of Patent: May 17, 2011

(54) RIBBON CARTRIDGE AND PRINTING APPARATUS

(75) Inventors: Masayuki Kumazaki, Matsumoto (JP); Shinji Sato, Date (JP); Takumi Kawamura, Date (JP)

(73) Assignee: Seiko Epson Corporation, Tokyo (JP)

( * ) Notice: Subject to any disclaimer, the term of this patent is extended or adjusted under 35 U.S.C. 154(b) by 743 days.

(21) Appl. No.: 11/816,877

(22) PCT Filed: Feb. 24, 2006

(86) PCT No.: PCT/JP2006/303445

§ 371 (c)(1),
(2), (4) Date: Aug. 22, 2007

(87) PCT Pub. No.: WO2006/090842

PCT Pub. Date: Aug. 31, 2006

(65) Prior Publication Data

US 2009/0202283 A1 Aug. 13, 2009

(30) Foreign Application Priority Data

Feb. 24, 2005 (JP) ..... P2005-049038

(51) Int. Cl.
*B41J 35/04* (2006.01)

(52) U.S. Cl. ..... 400/248; 400/247; 400/248.1

(58) Field of Classification Search ..... 400/248, 400/247, 211, 212, 213, 250
See application file for complete search history.

(56) References Cited

U.S. PATENT DOCUMENTS

| | | | | | |
|---|---|---|---|---|---|
| 4,402,621 | A | * | 9/1983 | Abell et al. | 400/208 |
| 4,856,923 | A | * | 8/1989 | Smith | 400/247 |
| 4,948,278 | A | * | 8/1990 | Schiffmacher et al. | 400/248 |
| 5,366,304 | A | | 11/1994 | Sheehan et al. | |

FOREIGN PATENT DOCUMENTS

| | | | | |
|---|---|---|---|---|
| JP | 64-26490 | | | 1/1989 |
| JP | 01026490 | A | * | 1/1989 |
| JP | 03007374 | A | * | 1/1991 |
| JP | 7-89204 | | | 4/1995 |
| JP | 7-251553 | | | 10/1995 |
| JP | 8-90888 | | | 4/1996 |
| JP | 8-238831 | | | 9/1996 |
| JP | 2004-351689 | | | 12/2004 |
| JP | 2004351689 | A | * | 12/2004 |

* cited by examiner

*Primary Examiner* — Daniel J Colilla
(74) *Attorney, Agent, or Firm* — Nixon & Vanderhye P.C.

(57) ABSTRACT

A ribbon guide includes a pair of upper and lower plates for limiting upper and lower ends of an ink ribbon. A ribbon guide plate is disposed between the pair of upper and lower plates so as to guide a non-transfer surface of the ink ribbon. Ribbon press bars are suspended between the pair of upper and lower plates so as to guide a transfer surface of the ink ribbon. Cutouts through which the ink ribbon is inserted are formed at the lower plate so as to surround lower end portions of the ribbon press bars.

9 Claims, 12 Drawing Sheets

RIBBON CARTRIDGE AND PRINTING APPARATUS

This application is the U.S. national phase of International Application No. PCT/JP2006/303445 filed 24 Feb. 2006 which designated the U.S. and claims priority to Japanese Patent Application No. 2005-049038 filed 24 Feb. 2005, the entire contents of each of which are hereby incorporated by reference.

TECHNICAL FIELD

The present invention relates to a ribbon cartridge having a ribbon guide for guiding a running path of an ink ribbon and a printing apparatus having the ribbon cartridge, and more particularly, to an arrangement for stabilizing a running path of an ink ribbon.

BACKGROUND ART

In the past, as a printing apparatus, a dot-impact printer has been known which is provided with a print head for impacting on a print wire and an ink ribbon cartridge for receiving an ink ribbon, and in which an image is printed on a print sheet by allowing the print wire to collide with the print sheet on a platen where the ink ribbon sent from the ink ribbon cartridge is interposed between the print sheet and the print wire. In such a printer, a ribbon guide is provided so as to securely move the ink ribbon sent from the ink ribbon cartridge to the front side of the print wire.

In general, the ribbon guide includes a pair of guide frames that are disposed on the left and right sides of an insertion hole into which the print head is inserted. The ribbon guide is configured to guide the ink ribbon so that the ink ribbon enters into one guide frame, passes through a front side of the print head, and exits from the other guide frame, and the upper and lower ends of the ink ribbon are guided by the upper and lower inner edges of the guide frames. Additionally, a slit is formed on each of the pair of guide frames so that the ink ribbon is inserted into the ribbon guide via the slit. In prior art arrangements, a slit has been formed on an upper surface of the guide frame so as to extend along the running direction of the ink ribbon (for example, see Japanese Patent Publication JP-A-7-89204). A slit has also been formed on the upper surface of each of the pair of guide frames so as to extend along the direction substantially perpendicular to the running direction of the ink ribbon (for example, see Japanese Patent Publication JP-A-238831); and the like.

SUMMARY

However, when the slit is formed so as to extend along the running direction of the ink ribbon, the ink ribbon may slip out of the slit and derail from the ribbon guide when moving in the vertical direction perpendicular to the running direction in the course of running the ink ribbon.

Additionally, when the slit is formed on a portion of the guide frame so as to extend along the direction substantially perpendicular to the running direction of the ink ribbon, the guide frame has a cantilever shape. As a result, the running path of the ink ribbon becomes unstable, and a ribbon jam may occur.

The present construction is contrived in consideration of the above-mentioned problems, and an object is to provide a ribbon cartridge and a printing apparatus capable of preventing an ink ribbon from derailing while enabling stable running thereof.

In order to achieve the above-mentioned object, a ribbon cartridge includes a ribbon guide through which an ink ribbon is inserted, in which the ribbon guide includes a pair of plates limiting upper and lower ends of the ink ribbon, a guide member disposed between the pair of plates so as to guide a non-transfer surface of the ink ribbon, and a bar member suspended between the pair of plates so as to guide a transfer surface of the ink ribbon. A cutout through which the ink ribbon is inserted is formed at one of the pair of plates so as to surround one end portion of the bar member.

Since the cutout through which the ink ribbon is inserted is formed at one of the pair of plates so as to surround the bar member, the cutout is provided with a cutout portion extending with a predetermined slope relative to the running direction of the ink ribbon. Thus, it is possible to prevent the ink ribbon from derailing from the ribbon guide even when a vertical directional force is applied to the ink ribbon in the course of the running thereof.

Additionally, since the pair of plates does not have a cantilever shape, the running path of the ink ribbon does not become unstable. Thus, it is possible to enable stable running of the ink ribbon and thus to prevent occurrence of a ribbon jam.

In the ribbon cartridge of the invention, the ribbon cartridge may be configured with a plurality of the bar members disposed in a running direction of the ink ribbon, and the cutout through which the ink ribbon is inserted is formed at one of the pair of plates so as to surround one end portion of each bar member.

With such a configuration, since a plurality of the bar members are provided to the ribbon cartridge, even when a force is applied to the bar member in the direction in which the transfer surface of the ink ribbon presses the bar members, the load applied to the bar members is distributed to each bar member. Thus, it is possible to prevent bending of the bar members and thus to enable a stable running of the ink ribbon.

In the ribbon cartridge described herein, the ribbon cartridge may be configured such that the cutout has a side extending in a direction substantially perpendicular to the running direction of the ink ribbon.

With such a configuration, it is possible to prevent the ink ribbon from derailing from the cutout in a secure manner.

The ribbon cartridge may be configured such that a section, which is perpendicular to the running direction of the ink ribbon, of the end portion of the bar member surrounded with the cutout has a substantially L shape.

With such a configuration, the end portion of the ink ribbon is guided by the substantially L-shaped bar members as well as the plates.

The ribbon cartridge may be configured such that one end portion of the ribbon guide in the running direction of the ink ribbon is provided with the guide member, and a surface of the guide member coming in contact with the ink ribbon has a curvature.

With such a configuration, it is possible to smoothly guide the ink ribbon that enters in the ribbon guide or exits from the ribbon guide.

The ribbon cartridge may be configured such that the bar member and the guide member are disposed on both sides in the running direction of the ink ribbon.

With such a configuration, an entrance hole for allowing the ink ribbon to enter therein and an exit hole for allowing the ink ribbon to exit therefrom are formed in the running path of the ink ribbon.

Further, in order to achieve the above-mentioned object, the present invention provides a printing apparatus for printing an image on a print sheet by allowing a print head to impact on a print wire so as to collide with the print sheet supplied onto a platen with the ink ribbon sent from the ink ribbon cartridge interposed therebetween.

DETAILED DESCRIPTION OF PREFERRED EMBODIMENTS

Hereinafter, an embodiment will be described with reference to the drawings. In the following embodiment, an example will be described in which the device is applied to a dot-impact printer.

Figure 1:
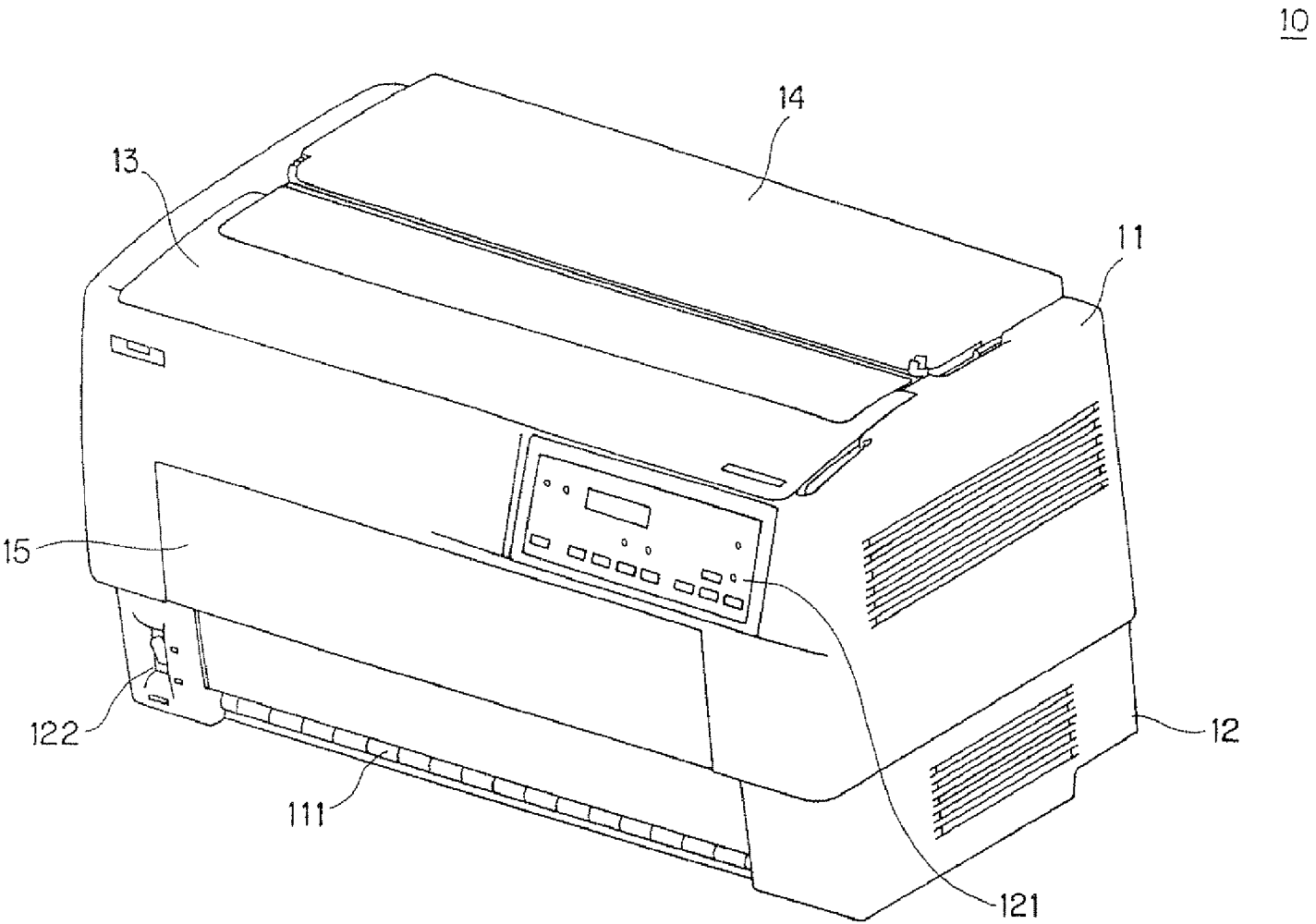
FIG. 1 is an external perspective view showing a dot-impact printer.
Figure 2:
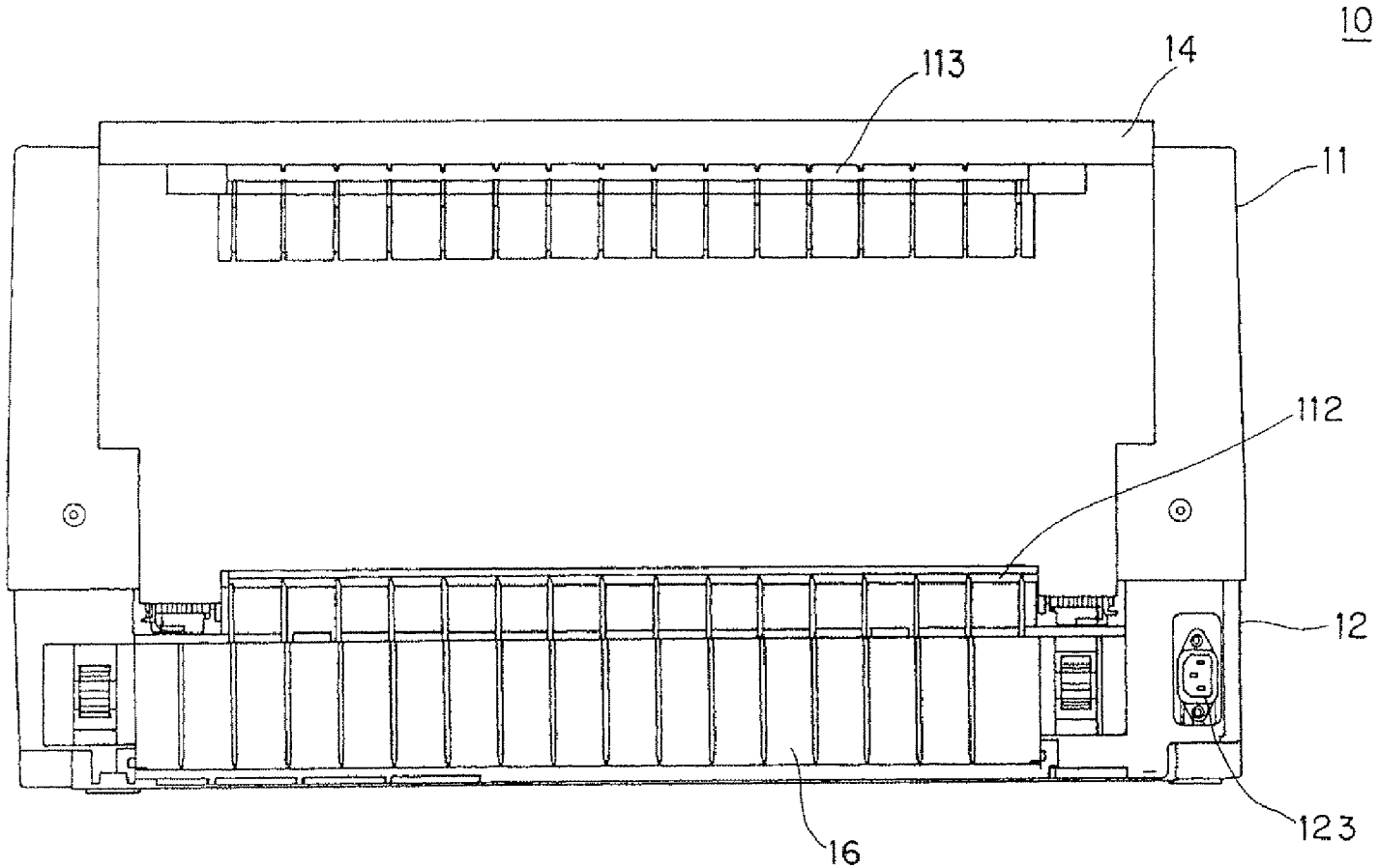
FIG. 2 is a rear elevation view showing the dot-impact printer.
Figure 3:
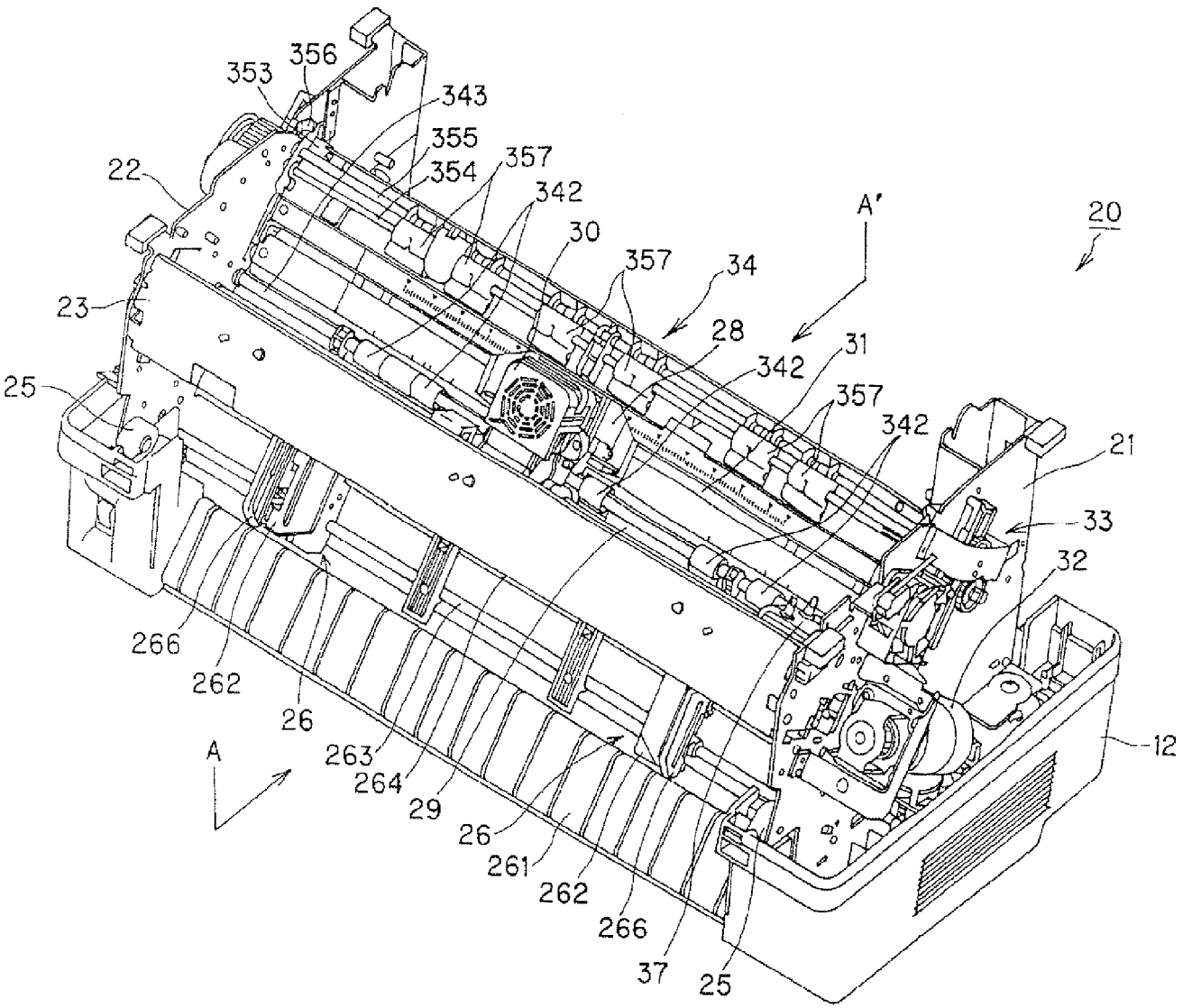
FIG. 3 is a perspective view showing a configuration of a printer part.
Figure 4:
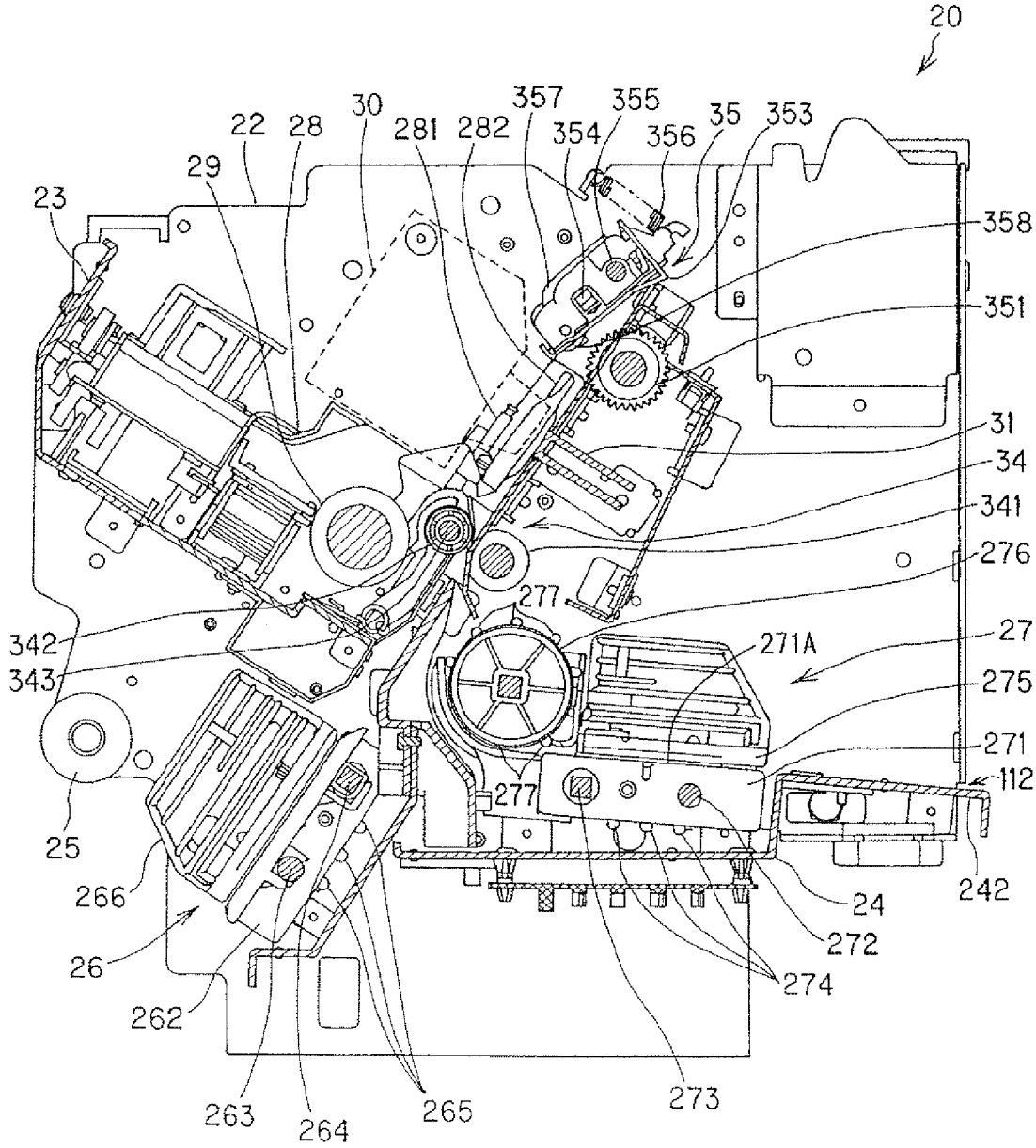
FIG. 4 is a sectional view showing the printer part.
Figure 5:
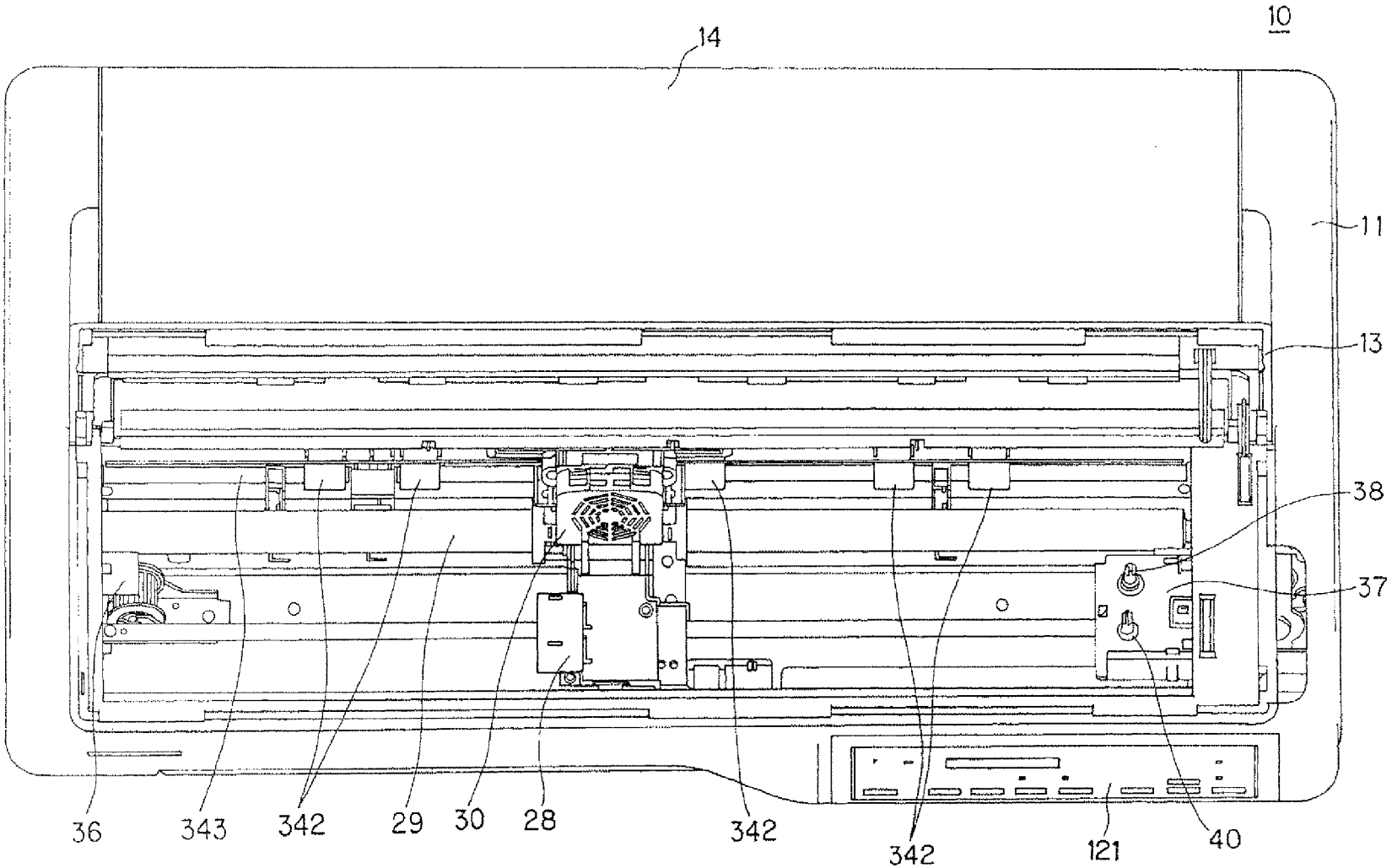
FIG. 5 is a top plan view showing the dot-impact printer.
Figure 6:
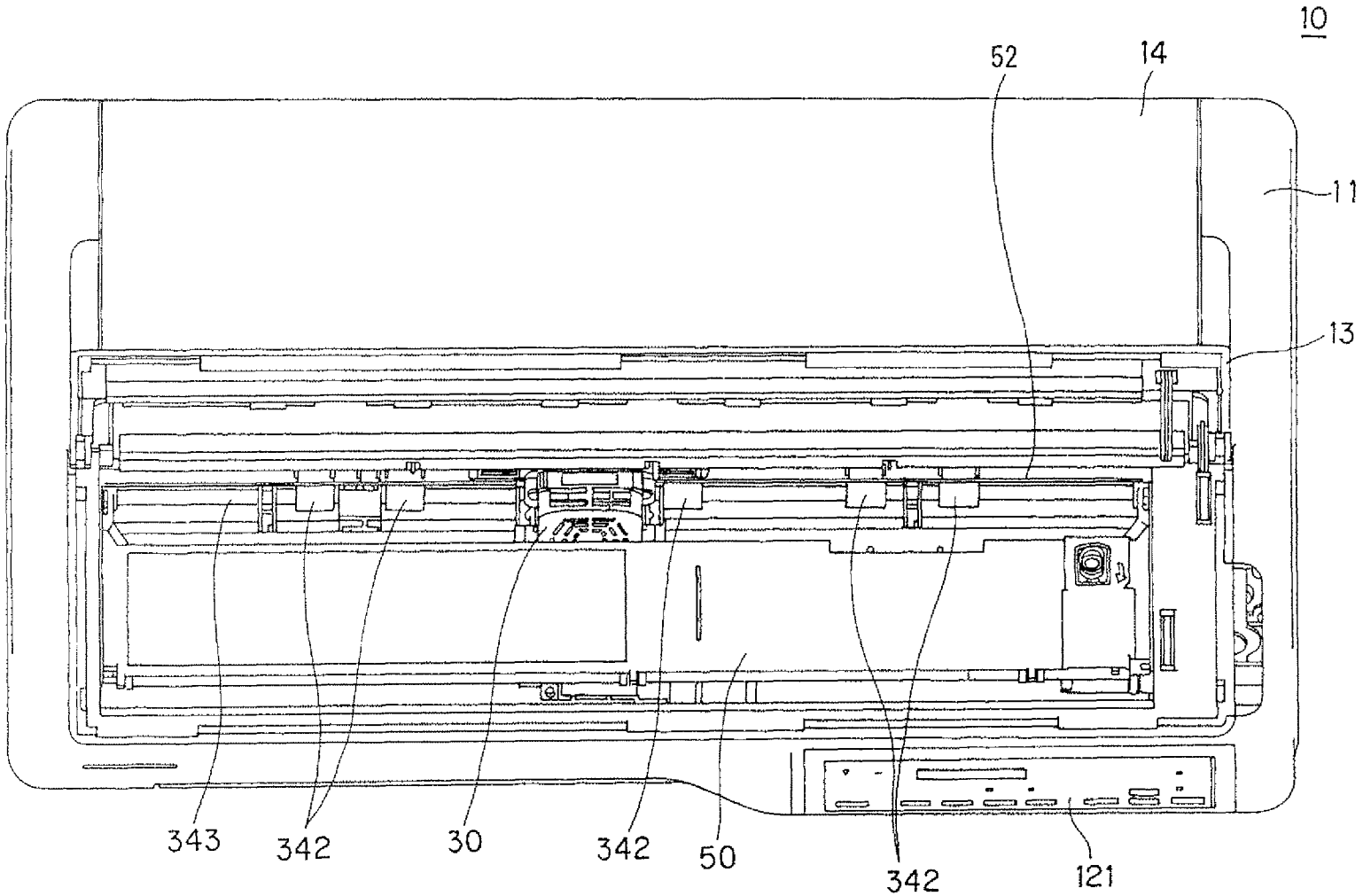
FIG. 6 is a top plan view showing the dot-impact printer.

FIG. 1 is an external perspective view showing a dot-impact printer 10. FIG. 2 is a rear elevation view showing the dot-impact printer 10. FIG. 3 is a perspective view showing a configuration of a printer part 20 provided in the dot-impact printer 10. FIG. 4 is a sectional view showing the printer part 20 taken along A-A' line in FIG. 3. FIG. 5 is a top plan view showing the dot-impact printer 10 when an upper-side cover 13 is opened. FIG. 6 is a top plan view showing the dot-impact printer 10 when a ribbon cartridge 50 is mounted thereon after opening the upper-side cover 13.

The dot-impact printer 10 includes a print head 30 having a plurality of print wires (not shown), and is configured to print images including text on a print surface of a print sheet by allowing a print head 30 to protrude a print wire with an ink ribbon 52 interposed therebetween. In the below description, an example will be described in which a continuous-form paper is used as a print sheet.

As shown in FIG. 1, the dot-impact printer 10 has a substantial box-shaped outer housing formed of an upper case 11 and a lower case 12, and the printer part 20 (FIG. 3) is mounted into the outer housing.

An upper-side cover 13 is disposed on a front upper surface of the upper case 11, and is configured to be opened upward when a ribbon cartridge 50 (FIG. 6) (described later) is mounted on the printer part 20. A front paper-feeding portion 111 is formed on the front lower portion of the upper case 11 in an open manner so as to supply the continuous-form paper to the printer part 20. A front-side cover 15 is disposed on the front paper-feeding portion 111 so as to be openable in the front direction thereof. The front-side cover 15 is configured to set the continuous-form paper in the printer part 20 in an opened state.

As shown in FIGS. 1 and 2, an upper rear cover 14 is disposed on the upper case 11 so as to cover a surface of the upper case 11 extending from a rear portion of the upper surface to the bottom surface thereof. The upper rear cover 14 is configured to be openable in the back direction of the upper case 11 at the time of maintenance of the printer part 20. A paper ejecting portion 113 is formed on the rear surface of the upper rear cover 14 in an open manner so as to eject a printed continuous-form paper.

In the rear surface of the upper case 11, a rear paper-feeding portion 112 is formed below the upper rear cover 14 in an open manner so as to supply the continuous-form paper to the printer part 20.

As shown in FIG. 2, an I/F cover 16 is disposed on the lower rear surface of the lower case 12. A connector (not shown) is disposed inside the I/F cover 16 so as to connect the dot-impact printer 10 to various devices such as computers, and the I/F cover 16 is openable so as to enable a cable to be connected to the connector.

As shown in FIG. 1, an operation panel 121 is disposed on the front upper portion of the upper case 11. The operation panel 121 includes switches for setting various operations of the dot-impact printer 10, an indicator and an LCD display panel for indicating its operation state, and the like. A switch 122 is disposed on the front corner of the upper case 11 so as to turn the power of the dot-impact printer 10 on and off. As shown in FIG. 2, a power-supply connector 123 is disposed on the rear surface of the lower case 12 so as to supply power to the dot-impact printer 10.

Next, a configuration of the printer part 20 will be described.

As shown in FIGS. 3 and 4, the printer part 20 includes a right-side frame 21, a left-side frame 22, a front frame 23, and a base frame 24, and these frames 21, 22, 23, and 24 form a main-body frame. A print head 30, a carriage 28 for loading the print head 30, a front paper-feeding mechanism 26 for supplying the continuous-form paper from the front side relative to the print head 30, a rear paper-feeding mechanism 27 for supplying the continuous-form paper from the rear side relative to the print head 30, a transport mechanism 34 for transporting the continuous-form paper supplied from the front paper-feeding mechanism 26 and the rear paper-feeding mechanism 27 to the print head 30, a paper ejecting mechanism 35 for ejecting the continuous-form paper printed by means of the print head 30, and a ribbon driving unit 37 for driving a ribbon cartridge 50 (FIG. 6) are disposed on the main-body frame.

The right-side frame 21 and the left-side frame 22 are fitted to both ends of the printer part 20 so as to be opposed to each other. The front frame 23 and the base frame 24 are suspended between the right-side frame 21 and the left-side frame 22. The front frame 23 is positioned in the front side of the printer part 20, and the base frame 24 is positioned in the lower rear side of the printer part 20.

A roller 25 is disposed on the front lower portions of the right-side frame 21 and the left-side frame 22, respectively, and the printer part 20 is supported by the lower case 12 with two rollers 25 interposed therebetween. Additionally, the roller 25 is configured to be rotatable. A maintenance operation can be performed to a control base (not shown) disposed below the printer part 20 where the printer part 20 is tilted upward about the roller 25.

The front paper-feeding mechanism 26 includes a front paper-feeding stand 261 disposed on the front lower portion of the printer part 20, a tractor support shaft 263, a tractor driving shaft 264, and a pair of left and right front tractors 262 horizontally suspended between the right-side frame 21 and the left-side frame 22, and a front tractor cover 266 fitted to each front tractor 262 in a single body.

The front paper-feeding stand 261 has a surface extending with its slope from a front lower portion of the printer part 20, and the surface upwardly supports the continuous-form paper supplied from the front paper-feeding portion 111 (FIG. 1). The tractor support shaft 263 and the tractor driving shaft 264 are disposed above the front paper-feeding stand 261, and the pair of left and right front tractors 262 insert through the tractor support shaft 263 and the tractor driving shaft 264. The front tractor 262 has a plane that is disposed so as to be connected to the surface of the front paper-feeding stand 261.

The front tractor 262 includes a tractor belt (not shown) having a plurality of pins 265. The tractor belt is suspended on the tractor support shaft 263 and the tractor driving shaft 264. The tractor support shaft 263 is rotatably disposed, and the tractor driving shaft 264 is driven to rotate by a transport motor. Additionally, the tractor belt is rotated with the rotation of the tractor driving shaft 264 and moves the pins 265 from below to above. The pins 265 are exposed from the plane of the front tractor 262 and engaged with a sprocket hole formed through both end portions of the width direction of the continuous-form paper. Further, when the pins 265 are moved by the rotation of the tractor belt, the continuous-form paper is transported upward, that is, toward the print head 30.

The front tractor cover 266 is disposed on the front tractor 262 so as to cover the pins 265 from their up direction. By covering the front tractor 262 loaded with the continuous-form paper with the front tractor cover 266, the sprocket holes of the continuous-form paper are maintained in engagement with the pins 265.

The rear paper-feeding mechanism 27 includes a tractor support shaft 272 and a tractor driving shaft 273 suspended between the right-side frame 21 and the left-side frame 22, a pair of left and right rear tractors 271, rear tractor covers 275 integrally fitted to the rear tractors 271, a rear tractor 271, and a sprocket wheel 276.

As shown in FIG. 4, the base frame 24 includes a sheet support portion 242 that extends on the same plane as a transport surface (upper surface) 271A of the rear tractor 271 and protrudes from the rear paper-feeding portion 112 of the dot-impact printer 10. The continuous-form paper supplied to the rear paper-feeding portion 112 is guided to the transport surface 271A of the rear tractor 271 while being supported by the sheet support portion 242.

The tractor support shaft 272 and the tractor driving shaft 273 are disposed substantially horizontal to each other. Two rear tractors 271 are inserted through the tractor support shaft 272 and the tractor driving shaft 273.

Each of the rear tractors 271 includes a tractor belt (not shown) having a plurality of pins 274 arranged at the same gap as sprocket holes disposed on both ends of the continuous-form paper. The tractor belt is suspended on the tractor support shaft 272 and the tractor driving shaft 273. The pins 274 of the tractor belt are exposed on the transport surface 271A of the rear tractor 271 so as to be inserted into the sprocket holes (not shown) of the continuous-form paper. Additionally, when the tractor belt is rotated by rotation of the tractor driving shaft 273, the continuous-form paper is transported by the rotation of the tractor belt.

A sprocket wheel 276 is formed downstream in the transport direction of the continuous-form paper relative to the rear tractor 271. The sprocket wheel 276 is disposed below a transport mechanism 34 (described later) so as to transport the continuous-form paper transported by the rear tractor 271 to the transport mechanism 34. Specifically, a plurality of pins 277 arranged at the same gap as the sprocket holes are formed on the circumference surface of the sprocket wheel 276. The pins 277 are inserted into the sprocket holes of the continuous-form paper transported by the rear tractor 271. Additionally, the sprocket wheel 276 and the rear tractor 271 are driven in synchronization with each other so as to transport the continuous-form paper to the transport mechanism 34. In such a synchronized state, the sprocket wheel 276 and the rear tractor 271 are driven by a transport motor (not shown) during printing so as to transport the continuous-form paper.

A rear tractor cover 275 for pressing the continuous-form paper is openably formed on the rear tractor 271 so as to cover the upper portion of the transport surface 271A. That is, when the continuous-form paper is set to the rear tractor 271, the rear tractor cover 275 is opened, the transport surface 271A is exposed, the sprocket holes of the continuous-form paper are inserted into the pins 277, and the rear tractor cover 275 is then closed. With such a configuration, an upper-surface position of the continuous-form paper is limited by the rear tractor cover 275, thus preventing the sprocket hole from getting out of the pins 274.

The transport mechanism 34 includes a first transport roller 341 and a second transport roller 342 that are opposed to each other so as to transport the continuous-form paper to the print head 30, a second transport roller shaft 343 for supporting the second transport roller 342, and a platen 31 opposed to the print head 30.

The first transport roller 341 is disposed above the sprocket wheel 276 while coming in contact with the other surface of the continuous-form paper. The second transport roller shaft 343 is disposed at a position opposed to the first transport roller 341 with the continuous-form paper interposed therebetween. The second transport roller shaft 343 is rotatably suspended between the right-side frame 21 and the left-side frame 22 so as to insert through a plurality of second transport rollers 342. The second transport roller shaft 343 is movable within a predetermined range by an operation of a roller opening/closing motor. When the roller opening/closing motor performs an opening operation, the second transport rollers 342 are detached from the first transport roller 341. When the roller opening/closing motor performs a closing operation, the second transport rollers 342 are biased toward the first transport roller 341.

By performing the closing operation of the roller opening/closing motor, the continuous-form paper is sandwiched between the first transport roller 341 and the second transport rollers 342. The first transport roller 341 is driven by the transport motor and a toothed driving wheel portion 33. By rotating the first transport roller 341, the continuous-form paper sandwiched between the first transport roller 341 and the second transport rollers 342 is transported in the upper direction, that is, toward the print head 30.

A carriage 28 is inserted through a carriage shaft 29 suspended between the right-side frame 21 and the left-side frame 22. A belt suspended on a carriage driving motor 32 and a carriage driving pulley (not shown) is fitted to the carriage 28. When the belt is driven by an operation of the carriage driving motor 32 and the carriage driving pulley, the carriage 28 is moved along the carriage shaft 29.

The print head 30 is mounted on the carriage 28. The print head 30 is opposed to a print surface of the continuous-form paper in the upper direction of the transport mechanism 34. An ink ribbon 52 drawn out from a ribbon cartridge 50 (described later) is disposed between the print surface of the continuous-form paper and the print head 30. Additionally, images including text are printed on the print surface of the continuous-form paper by allowing the print head 30 to hit the print wire (not shown) toward the print surface of the continuous-form paper so as to attach ink to the print surface.

In a position opposed to the print head 30, a platen 31 is disposed on the other surface of the continuous-form paper. The platen 31 is a flat platen in which a portion coming in contact with the continuous-form paper is a flat surface. This flat surface supports the ejection force of the print wire ejected from the print head 30. The platen 31 is configured to be movable in the vertical direction relative to the continuous-form paper and biased toward the continuous-form paper by means of a spring (not shown).

The paper ejecting mechanism 35 includes a first paper ejecting roller 351 that comes in contact with the continuous-form paper printed by the print head 30 from the rear direction, a movable frame 353 that is suspended from the right-side frame 21 to the left-side frame 22, a movable shaft 354 and a unit support shaft 355 that support the movable frame 353, a spring 356 that is suspended between the movable frame 353 and the left-side frame 22, a plurality of paper ejecting roller units 357 that are fixed to the movable frame 353, and a second paper ejecting roller 358 that is fitted to a paper ejecting roller unit 357.

The first paper ejecting roller 351 comes in contact with the other surface of the continuous-form paper in the upper direction of the print head 30 and rotates by means of the driving operation of the transport motor and the toothed driving wheel portion 33. The movable shaft 354 and the unit support shaft 355 are disposed in a position opposed to the first paper ejecting roller 351 with the continuous-form paper interposed therebetween. The movable shaft 354 and the unit support shaft 355 are suspended between the right-side frame 21 and the left-side frame 22. The unit support shaft 355 is fixed to the right-side frame 21 and the left-side frame 22. Additionally, the movable shaft 354 is configured to be movable in the circular direction about the unit support shaft 355. Further, the movable frame 353 is fixed to the movable shaft 354 and the unit support shaft 355 and is configured to be movable with the movable shaft 354.

A plurality of paper ejecting roller units 357 that are arranged in the axis direction of the movable shaft 354 and the unit support shaft 355 are fitted to the movable frame 353. A second paper ejecting roller 358 is fitted to the paper ejecting roller units 357 in a position apart from the unit support shaft 355.

The movable frame 353 is biased toward the direction close to the first paper ejecting roller 351 about the unit support shaft 355 by the spring 356 suspended between the left-side frame 22 and the movable frame 353. For this reason, the second paper ejecting roller 358 of the paper ejecting roller units 357 is biased toward the pressing direction of the first paper ejecting roller 351. Due to the bias force, the continuous-form paper is inserted between the first paper ejecting roller 351 and the second paper ejecting roller 358. The movable shaft 354 is thus moved while resisting the bias force of the spring 356 due to the operation of the roller opening/closing motor. That is, when the roller opening/closing motor performs an opening operation, the movable shaft 354 is moved while resisting the bias force of the spring 356 due to the driving force of the roller opening/closing motor, and the second paper ejecting roller 358 is detached from the first paper ejecting roller 351. Further, when the roller opening/closing motor releases the driving force (closing operation), the second paper ejecting roller 358 is pressed by the first paper ejecting roller 351 due to the bias force of the spring 356.

As shown in FIG. 5, a ribbon driving unit 37 is disposed on the front right end portion of the printer part 20. As shown in FIG. 3, the ribbon driving unit 37 is fixed to the right-side frame 21 and includes a substantially box-shaped cover, a ribbon winding shaft 38 protruding from the cover, and a winding detection shaft 40. Further, as shown in FIG. 5, a ribbon cartridge supporting claw 36 is disposed in the front left end portion of the printer part 20. The ribbon cartridge supporting claw 36 is a plate member that is integrally formed with the left-side frame 22.

As shown in FIG. 6, the ribbon cartridge 50 is fitted to the printer part 20 so as to be suspended between the ribbon cartridge supporting claw 36 and the ribbon driving unit 37. As shown in FIG. 6, the ribbon cartridge 50 is positioned at an upper portion of the carriage 28. Additionally, an ink ribbon 52 extending from the ribbon cartridge 50 passes through the gap between the print head 30 and the continuous-form paper.

Figure 7:
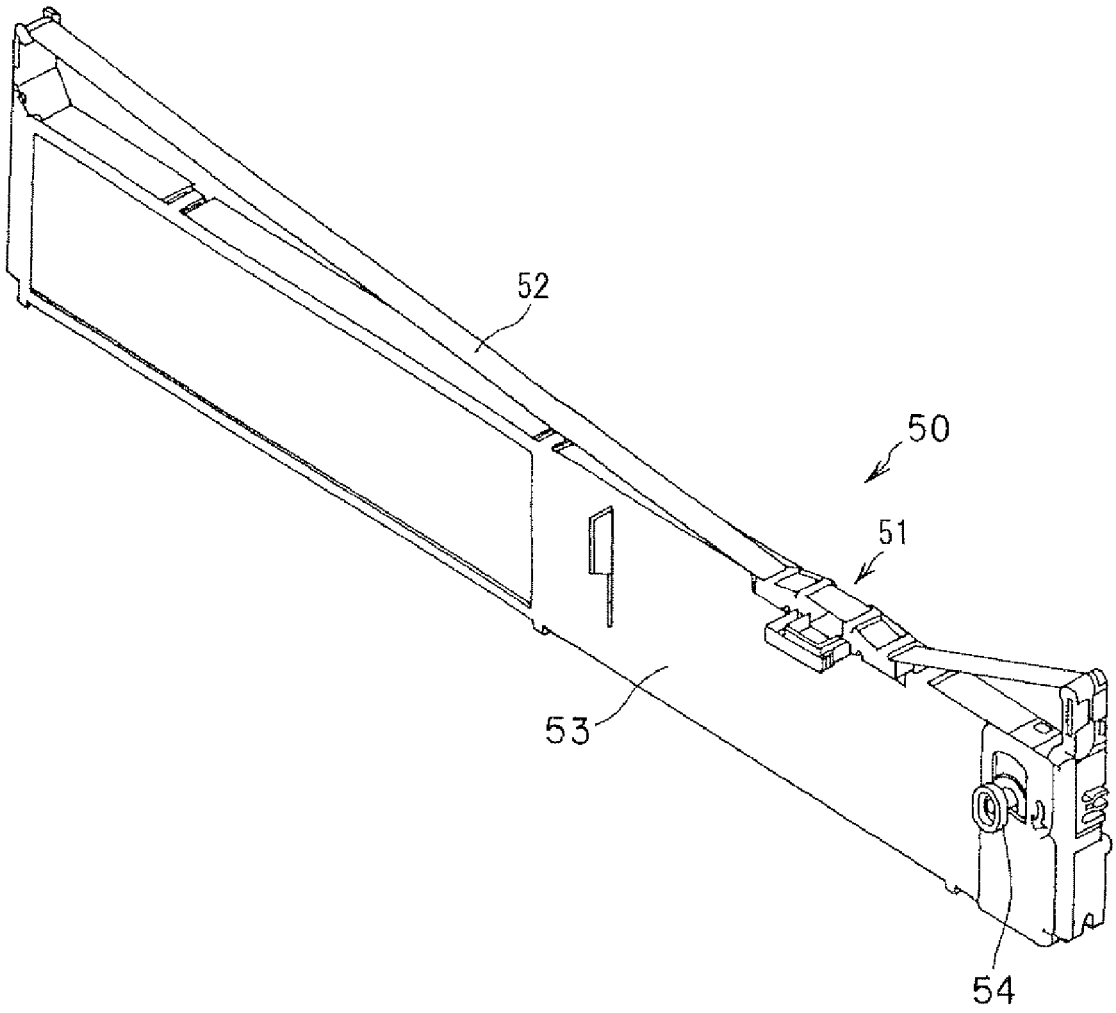
FIG. 7 is an external perspective view showing a configuration of a ribbon cartridge.
Figure 8:
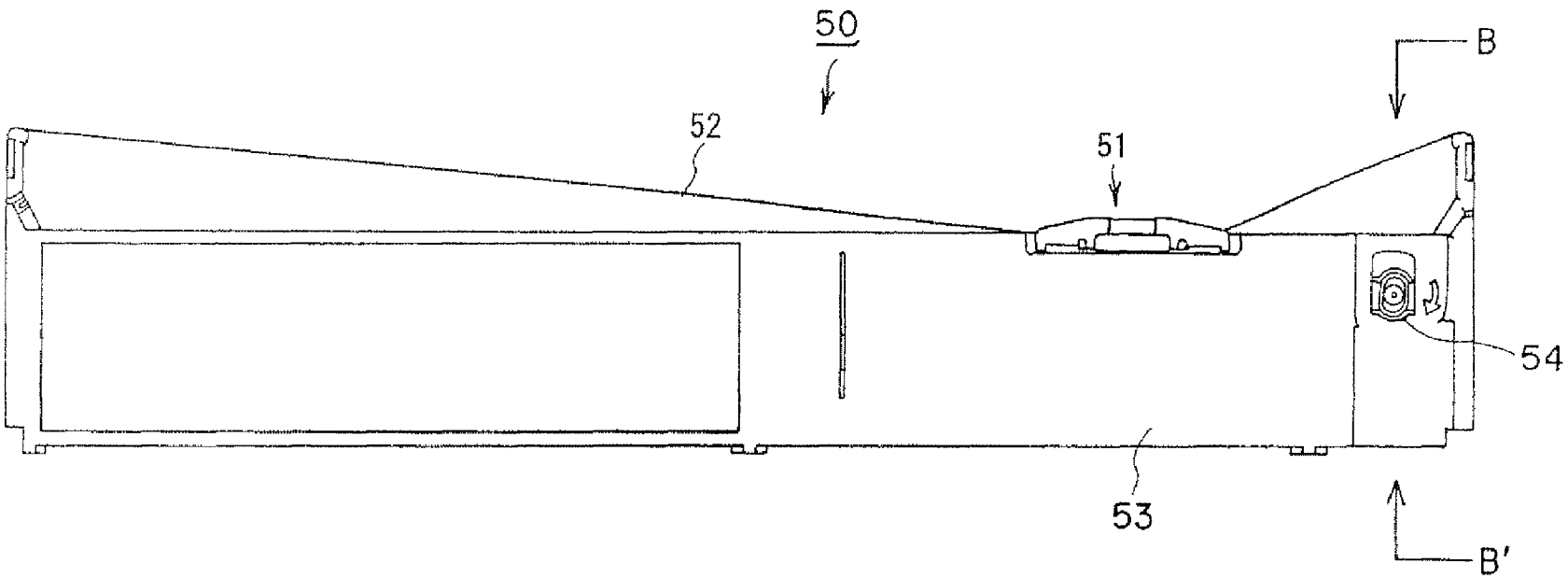
FIG. 8 is a top plan view showing the ribbon cartridge.
Figure 9:
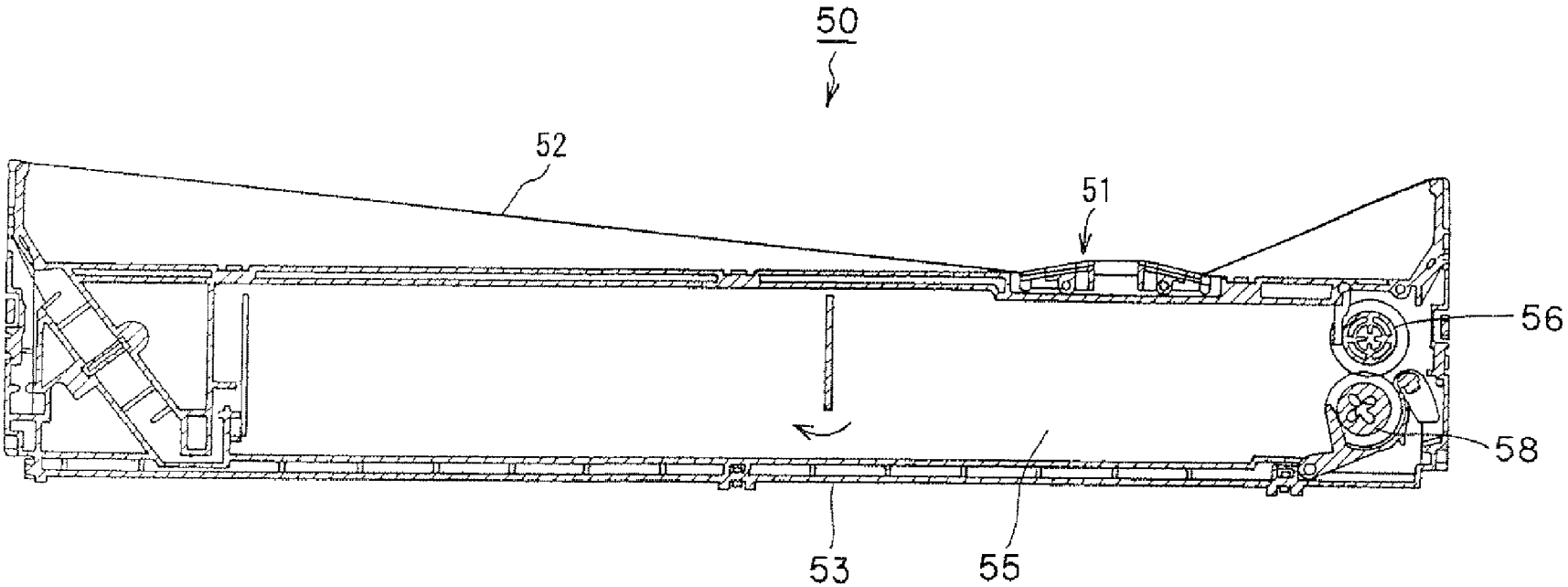
FIG. 9 is a vertical sectional view showing the ribbon cartridge.

FIG. 7 is an external perspective view showing a configuration of the ribbon cartridge 50. FIG. 8 is a top plan view showing the ribbon cartridge 50. FIG. 9 is a vertical sectional view showing the ribbon cartridge 50. As shown in FIGS. 7 to 9, the ribbon cartridge 50 has a generally flat casing 53. A ribbon reception portion 55 for receiving the ink ribbon 52 is formed in the casing 53 to receive the endless ink ribbon 52 in a folded manner. The ink ribbon 52 is wound on the winding roller 56 and the driven roller 58 and received in the casing 53. The ink ribbon 52 received in the ribbon reception portion 55 is drawn out and across the casing 53. A winding protrusion 54 protruding from the casing 53 is in communication with the winding roller 56 in the casing 53 and is configured to be capable of winding the ink ribbon 52 in the casing 53 by manually rotating the winding protrusion 54.

Figure 10:
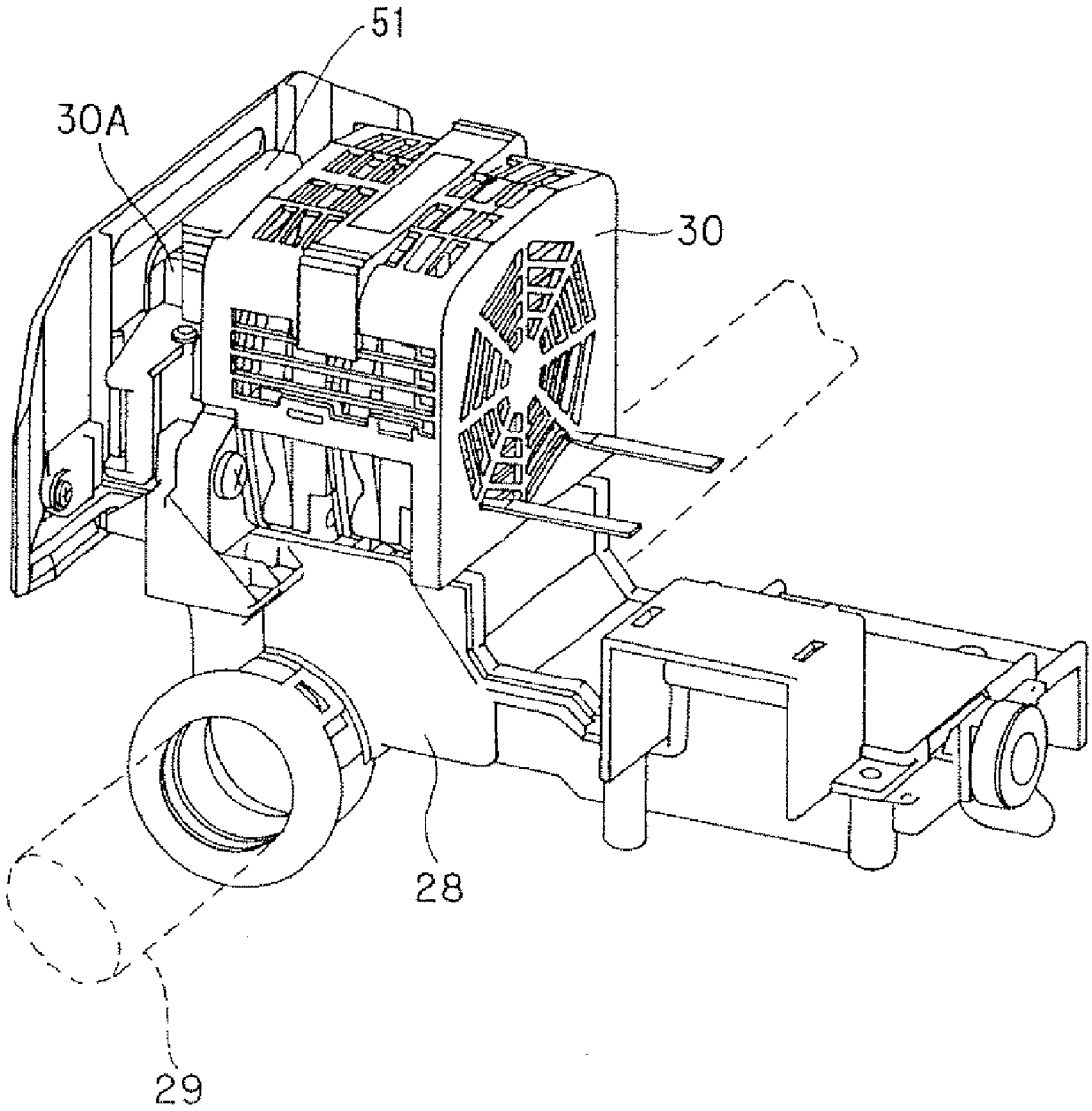
FIG. 10 is a view showing a state where a ribbon guide is mounted on carriage.

The ink ribbon 52 is inserted through the ribbon guide 51 outside the casing 53. As shown in FIG. 10, when the ribbon cartridge 50 is fitted to the dot-impact printer 10, the ribbon guide 51 is attached to the print head 30 after detaching from the casing 53, and the ink ribbon 52 is disposed on the front surface of a nose portion (print head) 30A of the print head 30.

Figure 11:
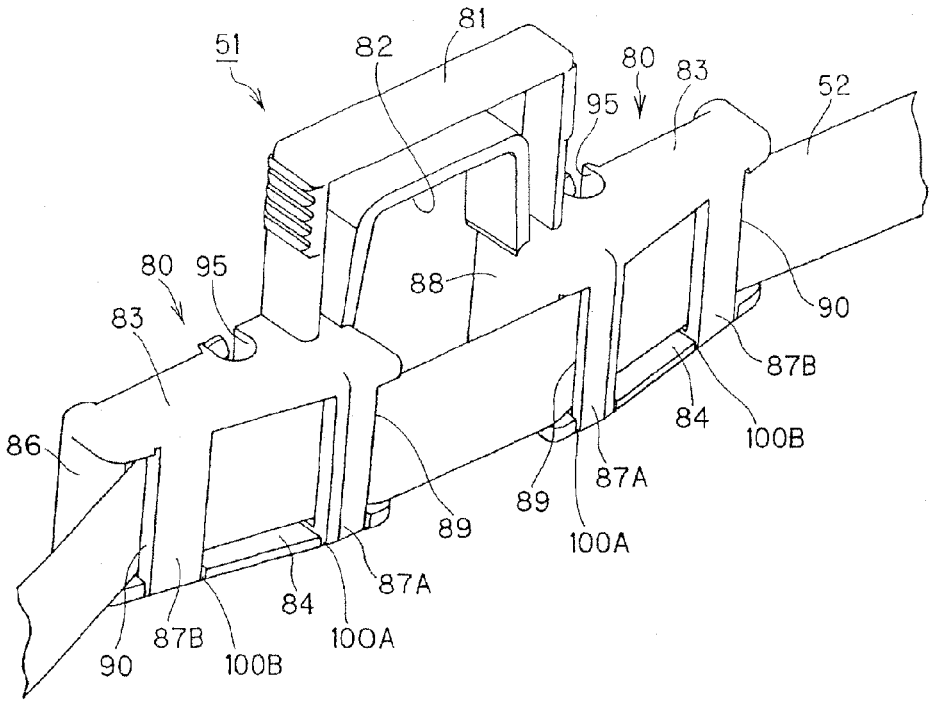
FIG. 11 is a view showing the ribbon guide and an ink ribbon.
Figure 12:
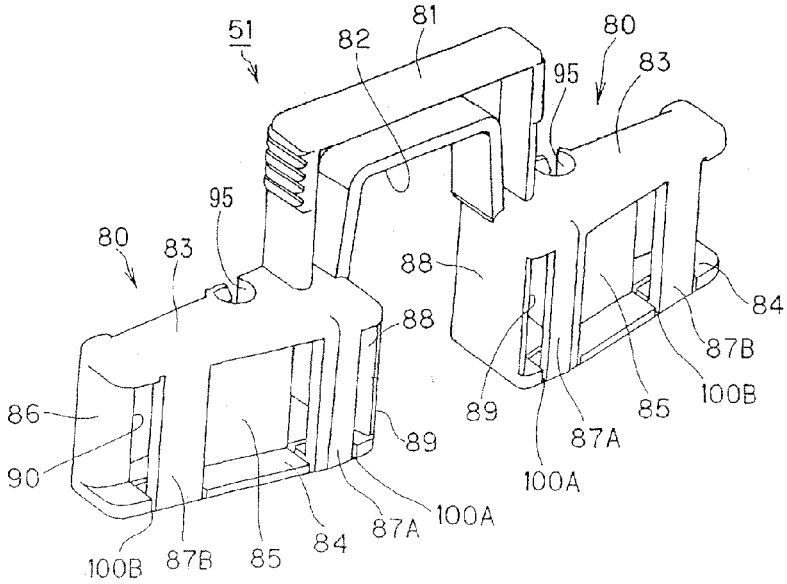
FIG. 12 is a perspective view showing a ribbon guide.
Figure 13:
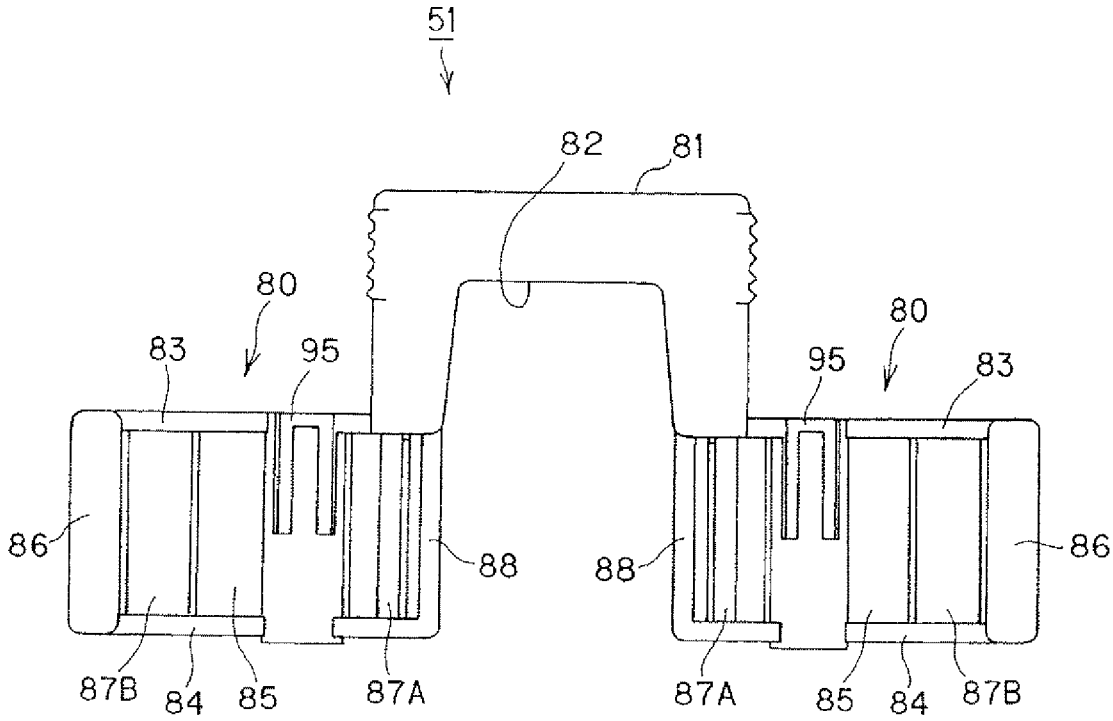
FIG. 13 is a rear elevation view showing the ribbon guide.
Figure 14:
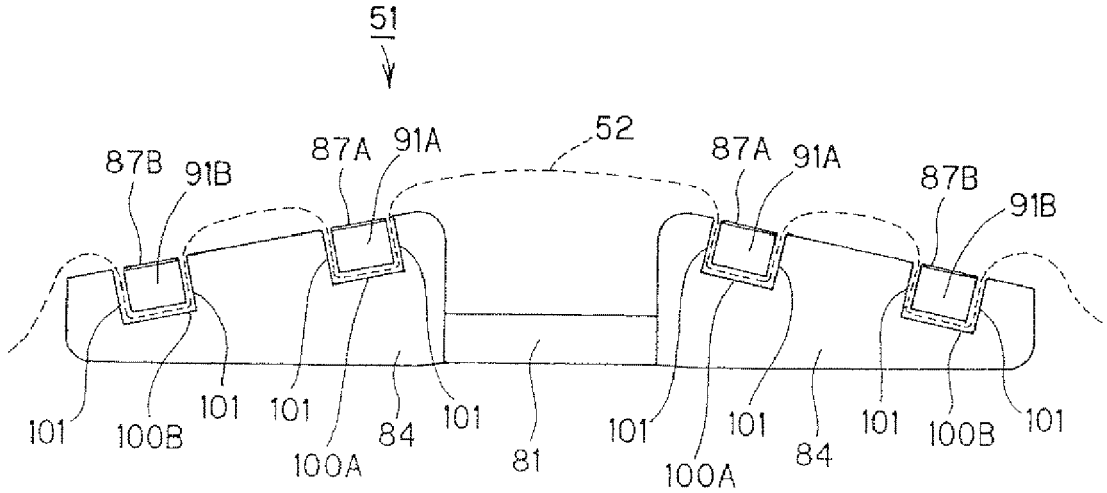
FIG. 14 is a bottom plan view showing the ribbon guide.

FIG. 11 is a perspective view showing the ribbon guide 51 into which the ink ribbon 52 is inserted. FIG. 12 is a perspective view showing a configuration of the ribbon guide 51. Additionally, FIG. 13 is a rear elevation view showing the ribbon guide 51. FIG. 14 is a bottom plan view showing the ribbon guide 51.

As shown in FIGS. 11 to 14, the ribbon guide 51 includes a pair of left and right guide bodies 80 and a U-shaped connection body 81 for connecting the pair of guide bodies 80 at a predetermined gap. These bodies are configured to be formed in a single body by the use of a resin or the like. The connection body 81 connects the pair of guide bodies 80 that are apart from each other. A head insertion hole 82 for inserting the nose portion 30A of the print head 30 is formed between the pair of guide bodies 80.

Each of the guide bodies 80 includes an upper plate 83 and a lower plate 84 for guiding the upper and lower end portions of the ink ribbon 52, a ribbon guide plate 85 and a ribbon guide pole 86 that are disposed facing a non-print-side surface of the ink ribbon 52, and two ribbon press bars 87A and 87B that are disposed facing a print-side surface of the ink ribbon 52. Additionally, an insertion hole 95 is formed in each of the guide bodies 80 so as to pass through the upper and lower plates 83 and 84 and be fitted to the pin (not shown) vertically provided on the carriage 28.

Each of the ribbon guide plates 85 and the ribbon guide bars 86 is integrally formed with the upper and lower plates 83 and 84 so as to connect the upper and lower plates 83 and 84 to each other in a rear surface side of the guide member 80, that is, a side of the print head 30. The ribbon guide plate 85 and ribbon guide pole 86 are sequentially disposed in this order from the side of the head insertion hole 82. Each of the ribbon guide plates 85 has a plane surface coming in contact with the non-transfer surface of the ink ribbon 52, and guides the non-transfer surface of the ink ribbon 52 in the guide body 80. Further, each of the ribbon guide bars 86 has a circumference surface formed with a smooth curvature and guides the non-transfer surface of the ink ribbon 52 that enters from the ribbon cartridge 50 to the guide body 80 when the ink ribbon 52 runs or exits from the guide body 80 to the ribbon cartridge 50.

Two ribbon press bars 87A and 87B are formed on the front side of the guide body 80, that is, the print sheet side so as to be suspended from the upper plate 83 to the lower plate 84 and configured as a bar member for pressing the transfer surface of the ink ribbon 52. Specifically, the ribbon press bars 87A and 87B are configured such that upper end portions of the ribbon press bars 87A and 87B are connected to the upper plate 83. Additionally, as shown in FIG. 14, the lower plates 84 are substantially cut in a U-shape so as to surround lower end portions 91A and 91B of the two ribbon press bars 87A and 87B and include cutouts 100A and 100B having cut-out sides 101 extending in a direction substantially perpendicular to the running direction of the ink ribbon 52. Further, the lower end portions 91A and 91B of the ribbon press bars 87A and 87B are detached from the lower plate 84 due to the cutouts 100A and 100B.

When the ink ribbon 52 is inserted into the ribbon guide 51, the ink ribbon 52 is inserted via the cutouts 100A and 100B. That is, when the ink ribbon 52 is inserted into the ribbon guide 51, the ink ribbon 52 is adjusted to a shape of the cutouts 100A and 100B as depicted by an imaginary line in FIG. 14 in a loosened state so as to insert the ink ribbon 52 into the ribbon guide 51, and then both ends of the ink ribbon 52 are pulled to each other so as to suspend the ink ribbon 52 between the pair of guide bodies 80 in a pulled state along the running direction as shown in FIG. 11. At this time, since the cutouts 100A and 100B have the cut-out sides 101 extending in a direction substantially perpendicular to the running direction of the ink ribbon 52, the ink ribbon 52 does not derail from the cutouts 100A and 100B when the ink ribbon 52 is pulled in the running direction.

Additionally, because the cutouts 100A and 100B are formed in a substantial U-shape on the lower plate 84, the lower end portions 91A and 91B of the ribbon press bars 87A and 87B have a substantial L-shape as viewed in the section. Accordingly, the ink ribbon 52 is inserted into the guide bodies 80 of the ribbon guide 51, and its lower end is guided by the lower end portions 91A and 91B of the ribbon press bars 87A and 87B as well as the lower plate 84.

A side plate 88 is integrally formed with the upper and lower plates 83 and 84 in the sides in which the pair of guide bodies 80 are opposed to each other. The running path of the ink ribbon 52 is formed in each of the guide bodies 80 by sequentially disposing the ribbon press bar 87A, the ribbon guide plate 85, the ribbon press bar 87B, and the ribbon guide pole 86 on both sides of the running direction from the side in which the side plate 88 in the running direction of the ink ribbon 52 is disposed. A first opening portion 89 formed between the side plate 88 and the ribbon press bar 87A and a second opening portion 90 formed between the ribbon guide pole 86 and the ribbon press bar 87B function as an entrance hole for inserting the ink ribbon 52 into the guide bodies 80 or an exit hole for drawing out the ink ribbon 52, respectively.

In such a configuration, during a printing operation, as shown in FIG. 11 the ink ribbon 52 drawn out from the ribbon cartridge 50 enters in the second opening portion 90 of one of the guide bodies 80, runs in the running path formed by the ribbon guide plate 85, the ribbon guide pole 86, and two ribbon press bars 87A and 87B, passes through the first opening portion 89, and then reaches the front of the nose portion 30A. Subsequently, the ink ribbon 52 enters in the first opening portion 89 of the other of the guide body 80, runs in the running path formed by the ribbon guide pole 86 and two ribbon press bars 87A and 87B, exits from the second opening portion 90 of the guide body 80, and runs toward the ribbon cartridge 50.

In a printing operation state, the running operation of the ink ribbon 52 and the moving operation of the carriage 28 may cause a shock to the ribbon guide 51. Particularly, in a high-speed printing state, the high-speed moving carriage 28 largely causes the shock. Examples of such shock include an up-down force on the ink ribbon 52, a direction force that the transfer surface of the ink ribbon 52 presses the ribbon press bars 87A and 87B, and the like.

In the embodiment, since the cutouts 100A and 100B for inserting ink ribbon 52 into the guide body 80 are formed in a substantial U-shape in the lower plate 84 and has the cut-out side 101 extending in a direction substantially perpendicular to the running direction of the ink ribbon 52, the ink ribbon 52 does not derail from the guide body 80 when an up-down force on the ink ribbon 52 is generated. Additionally, since the upper and lower ends of the ink ribbon 52 are guided by the upper and lower plates 83 and 84, it is possible to prevent the ink ribbon 52 from derailing in the vertical direction.

Still further, since the upper and lower plates 83 and 84 do not have a cantilever shape, the running path of the ink ribbon 52 does not become unstable. Accordingly, it is possible to enable a stable running of the ink ribbon 52 and thus to prevent occurrence of a ribbon jam.

Furthermore, since two ribbon press bars 87A and 87B are provided to the ribbon cartridge, even when a force is applied to the ribbon press bars 87A and 87B in the direction in which the transfer surface of the ink ribbon 52 presses the ribbon press bars 87A and 87B, the load applied to the ribbon press bars 87A and 87B is distributed to each ribbon press bar. With such a configuration, it is possible to stabilize the running of the ink ribbon 52 without causing bending of the ribbon press bars 87A and 87B.

The above-mentioned embodiment shows a first exemplary aspect of the invention and may be modified as any forms within the scope of the invention.

For example, although in the above-mentioned embodiment the guide body 80 is configured to include two ribbon press bars 87A and 87B, the guide body 80 may be configured to include a plurality of lines such as three ribbon press bars.

Further, although in the above-mentioned embodiment the cutouts 100A and 100B for inserting the ink ribbon 52 are formed in a substantial U-shape in the lower plate 84 so as to surround the lower end portions 91A and 91B of two ribbon press bars 87A and 87B, the shape of the cutouts 100A and 100B is not limited to the substantial U-shape. That is, the cutouts 100A and 100B may be formed in arbitrary shapes such as a shape having a cut-out side 101 extending in a direction substantially perpendicular to the running direction of the ink ribbon 52, or a shape having a cut-out side extending in a slight slope relative to the running direction of the ink ribbon 52.

Furthermore, although in the above-mentioned embodiment the ribbon press bars 87A and 87B are integrally formed with the upper plate 83, the ribbon press bars 87A and 87B may be integrally formed with the lower plate 84, and the cutouts 100A and 100B may be formed in the upper plate 83.

When the ribbon press bars 87A and 87B are integrally formed with the upper plate 83 or the lower plate 84, it is possible to increase the strength of the ribbon press bars 87A and 87B by properly modifying a shape or a thickness of its connection portion.

According to the embodiments described herein, since a cutout through which an ink ribbon is inserted is formed at one of a pair of plates so as to surround a bar member, it is possible to prevent the ink ribbon from derailing from a ribbon guide.

This application claims the benefit of Japanese Patent Application No. 2005-049038 filed Feb. 24, 2005, the entire contents of which are incorporated herein by reference.

The invention claimed is:

1. A ribbon cartridge, comprising a ribbon guide through which an ink ribbon is inserted, wherein the ribbon guide includes:

a pair of plate portions limiting upper and lower ends of the ink ribbon;

a guide portion disposed between the pair of plate portions so as to guide a non-transfer surface of the ink ribbon; and a bar portion extended from one of the pair of plate portions toward another of the pair of plate portions so as to guide a transfer surface of the ink ribbon, wherein the another of the pair of plate portions is formed with a recess, the recess being formed into a substantially U-shape in a cross sectional view so as to surround a tip end portion of the bar portion.

2. The ribbon cartridge according to claim 1, wherein a plurality of the bar portions are disposed in a running direction of the ink ribbon, and wherein a plurality of recesses are formed with the another of the pair of plate portions so as to surround the tip end portions of the bar portions, respectively.

3. The ribbon cartridge according to claim 1, wherein the recess has a side extending in a direction substantially perpendicular to the running direction of the ink ribbon.

4. The ribbon cartridge according to claim 1, wherein the end portion of the bar portion including the portion surrounded with the recess has a substantially L shape.

5. The ribbon cartridge according to claim 1, wherein one end portion of the ribbon guide in the running direction of the ink ribbon is provided with the guide portion, and wherein a surface of the guide portion coming in contact with the ink ribbon has a curvature.

6. The ribbon cartridge according to claim 1, wherein the ribbon guide comprises a left guide body and a right guide body disposed spaced from each other by a connection body to define a printing gap, and wherein the bar portion and the guide portion are disposed on both the left guide body and the right guide body in the running direction of the ink ribbon.

7. A ribbon cartridge according to claim 1, wherein the pair of plate portions, the guide portion and the bar portion are integrally formed with each other.

8. A printing apparatus for printing an image on a print sheet by allowing a print head to impact on a print wire so as to collide with the print sheet supplied onto a platen with the ink ribbon sent from the ink ribbon cartridge according to claim 1 interposed therebetween.

9. A ribbon cartridge including a casing housing an ink ribbon and a ribbon guide through which the ink ribbon is guided during use, the ribbon guide comprising:

an upper plate and a lower plate limiting upper and lower ends of the ink ribbon;

a guide member connected between the upper and lower plates so as to guide a non-transfer surface of the ink ribbon; and at least one bar member extending between the upper and lower plates so as to guide a transfer surface of the ink ribbon, the at least one bar member being fixed to one of the upper and lower plates, wherein the other of the upper and lower plates includes a corresponding at least one cutout into which the at least one bar member is suspended, the at least one cutout being formed into a substantially U-shape in a cross sectional view so as to surround a tip end portion of the at least one bar member, and wherein the ink ribbon is insertable between the upper and lower plates, across the guide member, and around the at least one bar member in the at least one cutout.

* * * * *